US005682783A

United States Patent [19]

Creamer et al.

[11] Patent Number: 5,682,783

[45] Date of Patent: Nov. 4, 1997

[54] CERAMIC TUBEMILL ROLL ASSEMBLY

[75] Inventors: Harvey B. Creamer, Luray; William E. Panthofer, Jackson, both of Tenn.; Mark J. Williams, Boston, N.Y.

[73] Assignee: Mill Masters, Inc., Jackson, Tenn.

[21] Appl. No.: 636,720

[22] Filed: Apr. 23, 1996

[51] Int. Cl.[6] ..... B21D 5/14; B21D 5/08; B21D 47/01; B21B 1/00

[52] U.S. Cl. ..... 72/182; 72/199; 72/366.2; 72/181

[58] Field of Search ..... 72/52, 366.2, 462, 72/181; 384/907.1, 297, 418; 492/59, 58

[56] References Cited

U.S. PATENT DOCUMENTS

| | | | |
|---|---|---|---|
| 3,535,904 | 10/1970 | Bindernagel | 72/199 |
| 3,577,619 | 5/1971 | Strandel | 29/148.4 |
| 4,056,873 | 11/1977 | Cassard et al. | 29/132 |
| 4,770,549 | 9/1988 | Rokkaku et al. | 384/907.1 |
| 4,777,822 | 10/1988 | Uemura et al. | 72/366 |
| 4,817,410 | 4/1989 | Yatsuzuka et al. | 72/199 |
| 4,876,875 | 10/1989 | Bruggeman et al. | 72/199 |
| 4,924,688 | 5/1990 | Cutmore | 72/199 |
| 5,005,395 | 4/1991 | Yasumura et al. | 72/52 |
| 5,040,398 | 8/1991 | Nakagawa et al. | 72/199 |
| 5,135,314 | 8/1992 | Momose et al. | 384/907.1 |
| 5,228,198 | 7/1993 | Paulman | 29/890.046 |
| 5,366,137 | 11/1994 | Gysi et al. | 72/52 |

FOREIGN PATENT DOCUMENTS

| | | | |
|---|---|---|---|
| 0093615 | 4/1989 | Japan | 348/907.1 |

*Primary Examiner*—Lowell A. Larson
*Assistant Examiner*—Rodney A. Butler
*Attorney, Agent, or Firm*—Gary M. Hartman; Domenica N. S. Hartman

[57] ABSTRACT

A roll assembly suitable for use in the production of thin-wall heat exchanger tubes using a high-frequency induction welding tubemill. The roll assembly includes a roll portion that has an arcuate precision profile that defines one-half of the desired cross-sectional shape of the tube being produced by the tubemill. The assembly further includes a shaft portion that directly supports the roll portion so as to serve as a journal bearing for the assembly. At least the bearing surfaces, and preferably the entire roll assembly is formed from ceramic or ceramic composite materials, without any separate bearing components. Moreover, the roll portion of the assembly is formed from a different material than the shaft portion, in a combination that reduces wear between the bearing surfaces of the roll and shaft portions.

15 Claims, 1 Drawing Sheet

CERAMIC TUBEMILL ROLL ASSEMBLY

BACKGROUND OF THE INVENTION

1. Field of the Invention

The present invention generally relates to roll assemblies of the type used in tubemills. More particularly, this invention relates to a preweld roll assembly for use in the production of thin-wall heat exchanger tubes using a high-frequency induction welding tubemill, in which the roll assembly is formed entirely from ceramic materials that uniquely enable the assembly components to exhibit exceptional wear resistance while also being sufficiently strong to withstand the demanding working environment of the assembly.

2. Description of the Prior Art

Thin-wall heat exchanger tubes are typically formed from brass, aluminum or steel alloys, and find applications in numerous types of heat exchangers, including radiators, heater cores and air conditioning equipment. While various manufacturing methods can be employed, a common high-volume manufacturing process entails the use of a tubemill in which flat stock is formed and welded to yield a round or flattened tubing, resulting in the presence of a weld seam running the length of the tubing. The process by which flat stock is transformed into a tube requires the use of guides and paired roller elements, including form rolls, preweld rolls and weld rolls. Generally, form rolls impart the circular cross-sectional shape to the tubing, preweld rolls align the stock and its opposing longitudinal edges for passage through the weld rolls, and weld rolls push the longitudinal edges together as it passes through a welding unit, such as a high-frequency induction welder, such that the edges become welded together. The dimensional tolerances for these rollers are particularly critical for production of thin-wall tubing, i.e., tubing having a wall thickness-to-tube diameter ratio of about 0.04 and less, because of the difficulty in precisely aligning the edges of the flat stock at the high line speeds commonly used in high volume tubemills.

Because each type of roll performs a unique function, their material and design requirements can significantly differ in order to withstand the particular loads and abrasion associated with their operation. For example, preweld rolls have a heightened requirement for both dimensional and mechanical integrity due to their function of both forming the flat stock and precisely aligning the stock and its longitudinal edges immediately upstream of the weld rolls. Traditionally, each of these rolls, as well as the shafts by which they are supported to form a roll assembly, have been formed from a hardened tool steel. Because the roll assemblies are also subjected to high radial loads, these rolls have been supported on their shafts by bearing elements, such as roller bearings, or secured to their shafts which in turn are supported by roller bearings. Due to the considerable wear inflicted on the rolls by the stock as it is formed and compressed, tool steel rolls have been evaluated and used with various wear-resistant coatings, including titanium nitride. Such ceramic coatings are advantageous not only for their wear resistance, but also for their nonconductive characteristic when present on the preweld and weld rolls. Specifically, if high-frequency induction welding equipment is employed to form the weld seam, preweld and weld rolls formed from conventional tool steel are subject to electrical etching, arcing and overheating, which drastically reduces their useful life, as well as the life of their bearings. While ceramic coatings are beneficial in reducing these adverse effects on the rolls, tool steel surfaces remain exposed because the brittle nature of ceramics has generally limited their use to the wear surfaces of the rolls. For example, it has been generally impracticable to coat the shafts, bearings and axial faces of the rolls, and as such their uncoated surfaces remain prone to electrical etching, arcing and overheating as a result of the induced electrical field in the vicinity of the welder.

Thus, it would be desirable to provide a roll assembly for a high-frequency induction weld tubemill that exhibits the strength and wear resistance necessary for a long service life, yet is also insusceptible to the adverse effects of being located adjacent the induction welder, including the tendency for electrical etching, arcing and overheating. Such a roll assembly must also be capable of being mass produced while maintaining tight dimensional tolerances in order to be used for high volume production of thin-wall tubing.

SUMMARY OF THE INVENTION

It is an object of this invention to provide a roll assembly for a tubemill, and particularly for use in the production of thin-wall heat exchanger tubes with a high-frequency induction welding tubemill to form a weld seam tube from metal flat stock.

It is a further object of this invention that such a roll assembly is constructed of a roll journaled on a shaft, each of which are entirely formed from non-conductive materials so as to be insusceptible to the adverse effects of being located adjacent the induction welder, including the tendency for electrical etching, arcing and overheating.

It is another object of this invention that such a roll assembly is configured as a preweld roll assembly for use in the high volume production of thin-wall tubing with an induction welding tubemill, and therefore is characterized by a requirement for high strength, wear resistance and closely-held dimensional tolerances.

It is yet another object of this invention that the roll and its shaft are formed from ceramics or ceramic composites characterized by high strength and the ability to be formed in a manner that enables tight dimensional tolerances to be maintained, so as to withstand the compression loads imparted on the stock being formed and welded.

Lastly, it is still another object of this invention that the roll and its shaft are formed from different materials, the result of which is an unexpected improvement in the wear resistance between the roll and shaft.

In accordance with a preferred embodiment of this invention, these and other objects and advantages are accomplished as follows.

According to the present invention, there is provided a roll assembly suitable for use in the production of thin-wall heat exchanger tubes using a high-frequency induction welding tubemill. The roll assembly includes a roll portion that has an arcuate precision profile that defines one-half of the desired cross-sectional shape of the tube being produced by the tubemill. The assembly further includes a shaft portion that directly supports the roll portion so as to serve as a journal for the assembly. In accordance with this invention, and contrary to the prior art, the entire roll assembly is preferably formed from ceramic or ceramic composite materials, without any separate bearing components. Moreover, the roll portion of the assembly is formed from a different material than the shaft portion, which has been unexpectedly found to reduce wear between the bearing surfaces of the roll and shaft portions. The material for the roll portion necessarily exhibits exceptional wear resistance relative to the tube material, while also being sufficiently strong to withstand the high loads to which the roll portion is subjected within the demanding working environment of a roll assembly. In comparison, the material for the shaft portion must exhibit exceptional wear resistance when used in combination with the roll portion material, while also being sufficiently strong to withstand the high bending loads to which the shaft portion is subjected while supporting the roll portion.

Preferably, the ceramic material for the roll portion is a silicon nitride ($Si_3N_4$) or zirconium oxide (zirconia; $ZrO_2$), which have been found to be particularly well suited for resisting wear when used as a preweld roll for forming brass and aluminum heat exchanger tubes. In contrast, a preferred ceramic material for the shaft portion is aluminum oxide (alumina; $Al_2O_3$), which has been surprisingly found to exhibit substantially lower wear rates within a preweld roll assembly than if the shaft portion were formed from silicon nitride, zirconia or any other ceramic or ceramic composite material.

In a high-frequency induction welding tubemill, a preweld roll assembly in accordance with this invention is used in pairs immediately ahead of a pair of weld rolls and an induction welding unit. The pairs are precisely located with a support frame, such that their arcuate profiles appropriately cooperate to align the unwelded, formed stock as it enters the weld rolls. Due to the desirable mechanical and wear-resistant properties of their different ceramic materials, the preweld roll assemblies exhibit exceptional wear resistance and strength in order to withstand their demanding working environment, while also being insusceptible to electrical etching, arcing and overheating induced by the high-frequency induction welder. Advantageously, the preferred combination of ceramic materials for the roll and shaft portions have been found to be capable of increasing the service life of the preweld roll assembly by a factor of about twenty-five over that of conventional tool steel preweld roll assemblies. In addition, and unexpectedly, the preferred combination of ceramic materials exhibits an increased service life by a factor of five over that possible if the rolls and shafts are formed from the same ceramic material, i.e., if both are formed from silicon nitride. Furthermore, these particular materials have been found to withstand the high loads to which a preweld roll assembly is subjected during operation. Finally, these materials have been found to be able to maintain the precise dimensional tolerances required of a preweld roll assembly.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
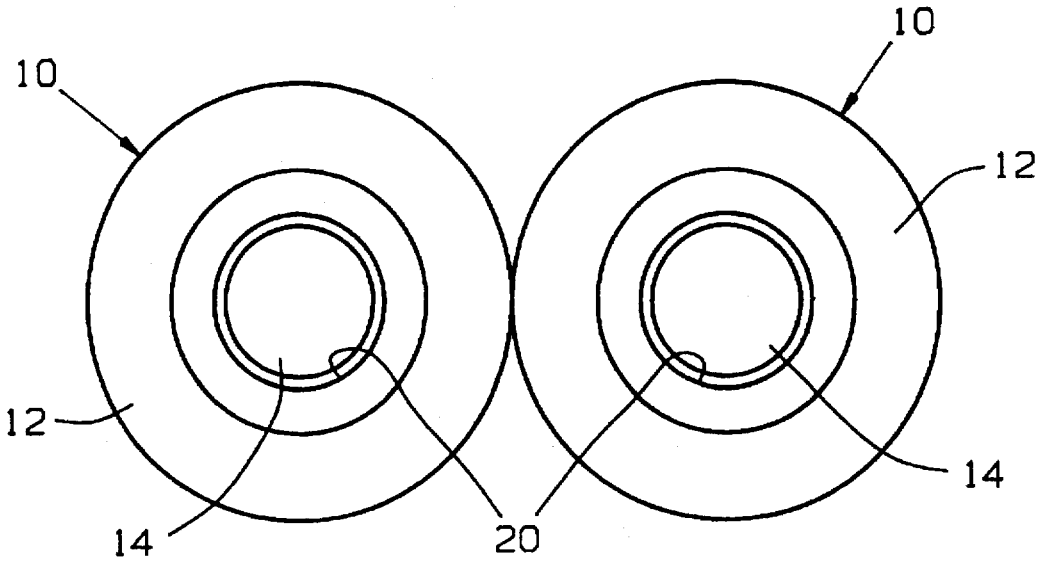
FIGS. 1 and 2 show top and front views, respectively, of a pair of preweld roll assemblies in accordance with this invention.
Figure 2:
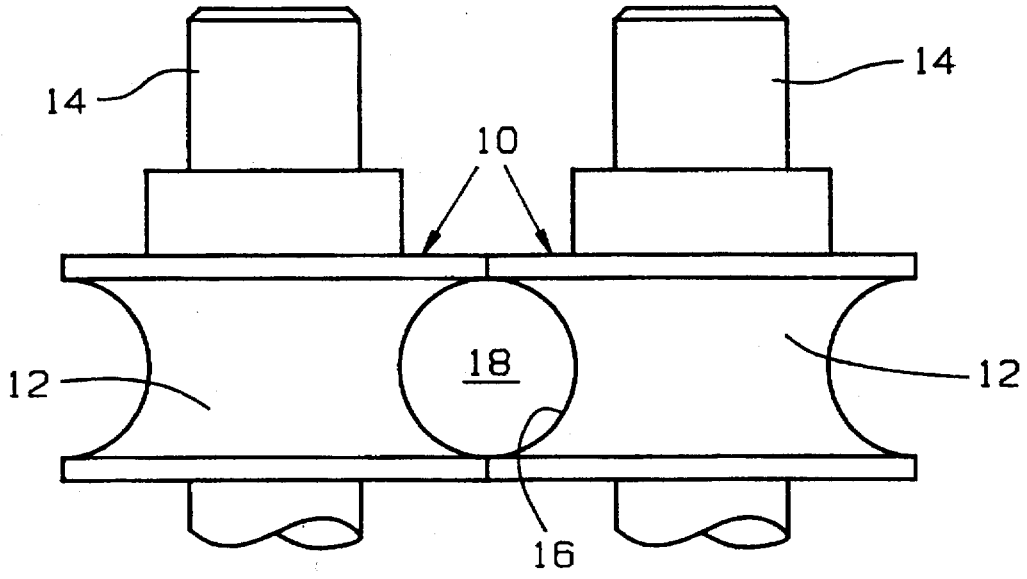

FIGS. 1 and 2 illustrate a pair of preweld roll assemblies 10 of the type encompassed by the teachings of this invention. According to the present invention, such preweld roll assemblies 10 are adapted for use in a high-frequency induction welding tubemill used in the production of thin-wall tubes, such as that employed in heat exchangers. The operating environment of such a tubemill exposes the roll assemblies 10 to particularly demanding conditions under which the roll assemblies 10 must guide stock formed previously be a series of forming rolls, and precisely compress and align the stock and its longitudinal edges prior to entering a pair of weld rolls at the welding unit. While the Figures illustrate a particular configuration for the roll assemblies 10, and the roll assemblies 10 will be described in the context of a preferred embodiment, those skilled in the art will appreciate that preweld roll assemblies of the type described above can vary considerably from that shown, and that such variations are within the scope of this invention.

Each of the roll assemblies 10 are shown as including a shaft 14 disposed coaxially within an axial bore 20 formed within a roll 12. Each roll 12 includes an arcuate precision profile 16 that, when the roll assemblies 10 are positioned as seen in FIG. 2, defines one-half of a desired cross-sectional shape 18 of a tube to be produced with the tubemill. According to this invention, the shaft 14 is not formed integrally with the roll 12, but is instead formed as a separate but mating component of the assembly 10. The shaft 14 serves as a journal for the assembly 10, such that the outer cylindrical surface of the shaft 14 bears against the bore surface of the roll 12. Furthermore, and contrary to the prior art, both the roll 12 and the shaft 14 are preferably formed entirely from different ceramic-based materials specifically tailored to satisfy the demanding mechanical, wear and dimensional requirements of the roll assemblies 10. Specifically, the ceramic material for the roll 12 necessarily exhibits exceptional strength and wear resistance in order to be capable of receiving, compressing and guiding brass, aluminum or steel stock at high line speeds. In addition, the ceramic material for the roll 12 and the ceramic material for the shaft 14 are chosen on the basis of exhibiting drastically reduced wear when used in combination, such that the service life of the roll assembly 10 is significantly improved, resulting in reduced downtime of the tubemill. In addition, the dielectric nature of the ceramic materials avoids the occurrence of electrical etching, arcing and over heating of the roll assemblies 10 that would otherwise be induced by the high-frequency induction welder.

According to this invention, preferred ceramic-based materials for the roll 12 are silicon nitride, such as a material identified as "SN220" and available from various manufactures such as Kyicera, and hot isostatically-pressed yttria-stabilized zirconia (YSZ), a suitable source of which is Coors Ceramics. Advantageously, these ceramic materials have been found to be machinable and exhibit dimensional stability during their processing, such that the precision profile 16 required of the rolls 12 can be achieved. While these ceramic materials have been found to have the necessary mechanical and wear characteristics and the dimensional stability for a preweld roll of a high-frequency induction weld tubemill, it is foreseeable that other materials could be formulated having comparable properties, and such materials are within the scope of this invention.

In further accordance with this invention, a preferred ceramic-based material for the shaft 14 is alumina, and particularly a 99.5 percent pure grade of alumina referred to as "995" available from various sources, including Coors Ceramics. Advantageously, alumina has been surprisingly found to be compatible with silicon nitride and YSZ under the operating conditions of a preweld roll assembly of the type shown in the Figures. Specifically, testing showed that, without separate bearing elements (e.g., roller or ball bearing assemblies) to physically separate the roll 12 and shaft 14, significantly lower wear occurred if the roll 12 and shaft 14 were formed from different materials as compared to rolls 12 and shafts 14 formed from the same material, such as silicon nitride. In particular, the combination of alumina for the shafts 14 and silicon nitride for the rolls 12 exhibited unexpected reduced wear by a factor of five as compared to silicon nitride-silicon nitride assemblies when tested under the operating conditions of a preweld roll assembly of the type illustrated in the Figures. Advantageously, the preferred silicon nitride, YSZ and alumina materials are machinable and exhibit dimensional stability during processing, such that the precision profile 16 required of the roll 12 and a preferred diametral clearance between the roll 12 and shaft 14 of about five to about eight micrometers (about 0.0002 to about 0.0003 inch) can be achieved. While these ceramic materials have been found to have the necessary mechanical and wear characteristics and the dimensional stability for a preweld roll assembly of a high-frequency induction weld tubemill, it is foreseeable that other combinations of ceramic-based materials, including ceramic composites, could achieve comparable results, and such materials are within the scope of this invention.

As used in a high-frequency induction welding tubemill, the preweld roll assemblies 10 of this invention are paired immediately ahead of a pair of weld rolls and an induction welding unit. The roll assemblies 10 are precisely positioned such that their profiles 16 appropriately cooperate to compress, align and guide the unwelded, formed stock as it enters the weld rolls. Due to the desirable properties of the preferred ceramic materials for the rolls 12, the preweld roll assemblies 10 exhibit exceptional wear resistance and strength, with a service life on the order of at least about twenty-five times longer than that of conventional tool steel preweld rolls. Notably, this material also readily withstands the high compression loads applied by each roll 12 to the stock.

It should be noted that the operating requirements of rolls employed in tubemills can vary considerably, depending on the location of the rolls within the forming process and relative to the welding unit. By example, while less wear-resistant materials may perform adequately in roll assemblies other than preweld roll assemblies, similarly adequate results cannot be necessarily achieved for the same materials in more demanding applications, such as the preweld roll assemblies 10 shown in FIGS. 1 and 2. Yet, this invention uniquely yields a preweld roll assembly 10 formed entirely of wear-resistant ceramic-based materials, and such a capability is in contrast to the accepted wisdom of the tubemill industry, which has relied on assemblies supported by separate bearing elements. In contrast, this invention employs different ceramic materials to form the roll 12 and shaft 14 of the roll assembly 10, such that a separate bearing element between the roll 12 and shaft 14 is unnecessary, while yielding a roll assembly 10 that exhibits a service life in excess of conventional steel-on-steel and ceramic-on-steel roll assemblies.

While our invention has been described in terms of a preferred embodiment, it is apparent that other forms could be adopted by one skilled in the art. Accordingly, the scope of our invention is to be limited only by the following claims.

The embodiments of the invention in which an exclusive property or privilege is claimed are defined as follows:

1. A roll assembly for use in the production of a thin-wall heat exchanger tube using a high-frequency induction welding tubemill, the roll assembly comprising:

a roll portion having an axial bore formed therein, the roll portion being formed entirely of a first ceramic-based material; and a shaft member received in the axial bore of the roll portion such that a surface portion of the member is a bearing surface that bears against the surface of the axial bore, the bearing surface being formed entirely of a second ceramic-based material having a composition that differs from the first ceramic-based material of the roll portion.

2. A roll assembly as recited in claim 1 wherein the first ceramic-based material is chosen of the group consisting of silicon nitride and YSZ.

3. A roll assembly as recited in claim 1 wherein the roll assembly is a preweld roll assembly.

4. A roll assembly as recited in claim 1 wherein the second ceramic-based material is alumina.

5. A roll assembly as recited in claim 1 wherein the second ceramic-based material is at least 99.5 percent pure alumina.

6. A roll assembly as recited in claim 1 wherein the shaft member is formed entirely from the second ceramic-based material.

7. A roll assembly as recited in claim 1 wherein the roll portion has an arcuate profile that defines one-half of a desired cross-sectional shape of the tube produced by the tubemill.

8. A roll assembly for use in the production of a thin-wall heat exchanger tube using a high-frequency induction welding tubemill, the roll assembly comprising:

a roll having an arcuate profile formed on its periphery that defines one-half of a desired cross-sectional shape of the tube produced by the tubemill, the roll being formed entirely of a ceramic material chosen from the group consisting of silicon nitride and YSZ, the roll having an axial bore formed therein; and a shaft received in the axial bore of the roll such that the shaft bears against the surface of the axial bore, the shaft being formed entirely of an alumina material, such that the shaft has a composition that differs from that of the roll.

9. A high-frequency induction welding tubemill for the production of a thin-wall heat exchanger tube, the tubemill comprising a pair of roll assemblies, each of the pair of roll assemblies comprising:

a roll portion having an axial bore formed therein, the roll portion being formed entirely of a first ceramic-based material; and a shaft member received in the axial bore of the roll portion such that a surface portion of the member is a bearing surface that bears against the surface of the axial bore, the shaft member being formed entirely of a second ceramic-based material having a composition that differs from the first ceramic-based material of the roll portion.

10. A tubemill as recited in claim 9 wherein the first ceramic-based material is chosen of the group consisting of silicon nitride and YSZ.

11. A tubemill as recited in claim 9 wherein the roll assembly is a preweld roll assembly.

12. A tubemill as recited in claim 9 wherein the second ceramic-based material is alumina.

13. A tubemill as recited in claim 9 wherein the second ceramic-based material is at least 99.5 percent pure alumina.

14. A tubemill as recited in claim 9 wherein the roll assembly is a weld roll assembly.

15. A tubemill as recited in claim 9 wherein the roll portion has an arcuate profile that defines one-half of a desired cross-sectional shape of the tube produced by the tubemill.

* * * * *

UNITED STATES PATENT AND TRADEMARK OFFICE

CERTIFICATE OF CORRECTION

PATENT NO. : 5,682,783
DATED : Nov. 4, 1997
INVENTOR(S) : Creamer et al.

It is certified that error appears in the above-indentified patent and that said Letters Patent is hereby corrected as shown below:

Title page, item [75] Inventors: "Harvey B. Creamer" should be corrected to -- Harvey G. Creamer --.

Signed and Sealed this

Seventeenth Day of March, 1998

*Attest:*

*Attesting Officer*

Bruce Lehman

BRUCE LEHMAN

*Commissioner of Patents and Trademarks*